US011478897B2

(12) United States Patent
Taniguchi et al.

(10) Patent No.: US 11,478,897 B2
(45) Date of Patent: Oct. 25, 2022

(54) BLASTING PROCESSING METHOD USING SHOT MEDIA

(71) Applicant: SINTOKOGIO, LTD., Nagoya (JP)

(72) Inventors: Hayato Taniguchi, Toyokawa (JP); Yuto Kato, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 84 days.

(21) Appl. No.: 16/963,336

(22) PCT Filed: Jan. 18, 2019

(86) PCT No.: PCT/JP2019/001534
§ 371 (c)(1),
(2) Date: Jul. 20, 2020

(87) PCT Pub. No.: WO2019/146529
PCT Pub. Date: Aug. 1, 2019

(65) Prior Publication Data

US 2020/0361058 A1 Nov. 19, 2020

(30) Foreign Application Priority Data

Jan. 25, 2018 (JP) ..... JP2018-010621

(51) Int. Cl.
*B24C 11/00* (2006.01)
*B24C 1/10* (2006.01)

(52) U.S. Cl.
CPC ..... *B24C 11/00* (2013.01); *B24C 1/10* (2013.01); *Y10T 29/479* (2015.01)

(58) Field of Classification Search
CPC .. B24C 1/10; B24C 11/00; C21D 7/06; Y10T 29/479
See application file for complete search history.

(56) References Cited

U.S. PATENT DOCUMENTS 6,604,698 B2 * 8/2003 Verhoff ..... B02C 17/161 977/797
10,287,171 B2 * 5/2019 Geertsen ..... B07B 1/22
2002/0117428 A1 * 8/2002 Rapaport ..... B03B 5/06 209/481

FOREIGN PATENT DOCUMENTS

| | | | |
|---|---|---|---|
| CN | 107000164 | A | 8/2017 |
| CN | 107000165 | A | 8/2017 |
| CN | 107206572 | A | 9/2017 |
| JP | 2000-052248 | A | 2/2000 |
| JP | 2001-353661 | A | 12/2001 |
| JP | 2003-342555 | A | 12/2003 |

(Continued)

OTHER PUBLICATIONS

English MAchien Translation of WO2017221894A1, Taniguchi Hayato, et al., Shot Material and Method for Surface Treatment of Metal Product Using Said Shot Material, Published Dec. 28, 2017.*

(Continued)

*Primary Examiner* — Sarang Afzali

(74) *Attorney, Agent, or Firm* — Faegre Drinker Biddle & Reath LLP

(57) ABSTRACT

A blasting processing method using shot media. A particle diameter distribution of the shot media before forming an operating mix is bimodal and substantially continuous, and both a first particle group corresponding to a first peak and a second particle group corresponding to a second peak are aggregates of particles in a shape having an angular part.

8 Claims, 5 Drawing Sheets

(56) References Cited

FOREIGN PATENT DOCUMENTS

| | | | |
|---|---|---|---|
| JP | 2016-194429 | A | 11/2016 |
| WO | WO-2016/143413 | A1 | 9/2016 |
| WO | WO-2016/143414 | A1 | 9/2016 |
| WO | WO-2016/174897 | A1 | 11/2016 |
| WO | WO-2017/221894 | A1 | 12/2017 |

OTHER PUBLICATIONS

International Preliminary Report on Patentability dated Aug. 6, 2020 for PCT/JP2019/001534.

* cited by examiner

BLASTING PROCESSING METHOD USING SHOT MEDIA

TECHNICAL FIELD

The present disclosure relates to shot media used for blasting processing.

BACKGROUND ART

Blasting processing is used for shake-out of a cast product after casting, deburring of a metal product, removal of scale such as rust, undercoat processing before coating, peeling off coating, removal of a surface thin layer of a floor surface or a wall surface (for example, a concrete road surface, a concrete subgrade for track rail, a factory concrete floor surface, or a concrete wall surface of a structure), and the like.

In accordance with materials of processing targets or purposes of blasting processing, particle diameters of shot media (hard particles projected toward a target area in the blasting processing) are selected. The particle diameters are determined in JIS (Japanese Industrial Standards) or the like, and shot media with a particle size distribution adjusted in response to a demand for improving the blasting processing performance are proposed (Patent Document 1).

Patent Document 1 discloses shot media that are mixture of main grains corresponding to the purpose of the blasting processing and sub-grains having a diameter smaller than that of the main grains and equal to or larger than a critical diameter that provides a surface cleaning effect. The particle size distribution of the shot media has at least a first peak based on the main grains and a second peak based on the sub-grains, and there is no substantial overlap between the first peak and the second peak. The shot media exhibit a higher blasting processing performance and less abrasion loss compared to a case where blasting processing is performed only with the main grains.

Recently, there has been a stringent demand for the quality of the processing target after execution of the blasting processing. Therefore, it is necessary to appropriately manage the particle size distribution of the shot media after forming an operating mix within a blasting apparatus, and more easily manageable shot media are desired.

Note that an operating mix is a stable particle size distribution different from the initial particle size distribution in operation of the blasting apparatus. In operation of the blasting apparatus, shot media in a predetermined amount is thrown into the blasting apparatus, and the shot media repeat a cycle of projection, recovery, removal of fine powder, and projection at the time of performing the blasting processing. When the projection is repeated, the shot media are crushed into fine powder. Such fine powder is sorted out and removed by a separator. Since the amount of the shot media in the blasting apparatus decreases by the amount removed, shot media corresponding to the amount of the decrease are supplied. After repeating feeding of the shot media, crushing, and discharge to the outside the apparatus, the particle diameter distribution of the shot media within the apparatus is stabilized to be a fixed particle diameter distribution different from the initial particle diameter distribution. An operating mix means the state of such stabilized particle diameter distribution.

CITATION LIST

Patent Literature

Patent Document 1: Japanese Unexamined Patent Publication No. 2001-353661

SUMMARY OF INVENTION

Technical Problem

In view of the above, the present disclosure provides shot media and a blasting processing method capable of efficiently and stably performing blasting processing.

Solution to Problem

An aspect of the present disclosure is iron-based shot media for performing blasting processing. A particle diameter distribution of the shot media before forming an operating mix is bimodal and substantially continuous, and both a first particle group corresponding to a first peak and a second particle group corresponding to a second peak are aggregates of particles in a shape having an angular part.

In an embodiment of the present disclosure, the particles included in the first particle group may be particles having an acute angular part and may have Vickers hardness of HV390 to 900.

In the embodiment of the present disclosure, the particles included in the second particle group may be columnar particles having an angular part and may have Vickers hardness of HV400 to 760.

In the embodiment of the present disclosure, a particle diameter segment of the first particle group may be 0.710 mm to 1.180 mm, and a particle diameter segment of the second particle group may be 0.355 mm to 0.600 mm.

Another aspect of the present disclosure is a blasting processing method. The blasting processing method includes following steps of (A) to (C):

(A) a step of loading the shot media being unused on a blasting apparatus;

(B) a step of forming the operating mix for stabilizing the particle diameter distribution of the shot media to be a fixed particle diameter distribution by operating the blasting apparatus; and (C) a step of projecting the shot media with the operating mix being formed toward a processing target.

Further, the particle diameter distribution after forming the operating mix is unimodal, and a particle diameter segment corresponding to a maximum value of a frequency is substantially the same as a particle diameter segment of the second particle group.

Advantageous Effects of Invention

According to the aspect and the embodiment of the present disclosure, it is possible to provide the shot media and the blasting processing method capable of efficiently and stably performing blasting processing. Further, according to the aspect and the embodiment of the present disclosure, it is possible to provide the shot media of a longer life compared to that of conventional shot media.

DESCRIPTION OF EMBODIMENTS

Shot media according to an embodiment of the present disclosure will be described by referring to the accompanying drawings. In the following description, upper, lower, left, and right directions are the directions on the drawings unless otherwise noted.

Further, the particle diameters in the following description indicate lower limit values in particle diameter segments. The particle diameter segments conform to test sieves (metal mesh sieves) defined in JIS Z8801-1: 2006. Table 1 shows representative values.

TABLE 1

| Particle diameter (mm) | Particle diameter segment (mm) |
|---|---|
| 3.350 | 3.350 to 4.000 |
| 2.800 | 2.800 to 3.350 |
| 2.360 | 2.360 to 2.800 |
| 2.000 | 2.000 to 2.360 |
| 1.700 | 1.700 to 2.000 |
| 1.400 | 1.400 to 1.700 |
| 1.180 | 1.180 to 1.400 |
| 1.000 | 1.000 to 1.180 |
| 0.850 | 0.850 to 1.000 |
| 0.710 | 0.710 to 0.850 |
| 0.600 | 0.600 to 0.710 |
| 0.500 | 0.500 to 0.600 |
| 0.425 | 0.425 to 0.500 |
| 0.355 | 0.355 to 0.425 |
| 0.300 | 0.300 to 0.355 |
| 0.250 | 0.250 to 0.300 |
| 0.212 | 0.212 0.250 |
| 0.180 | 0.180 to 0.212 |
| 0.150 | 0.150 to 0.180 |
| 0.125 | 0.125 to 0.150 |

The shot media according to the embodiment of the present disclosure is configured with an iron-based material. For example, C, Mn, Si, or the like may be included as an additional element.

Figure 1:
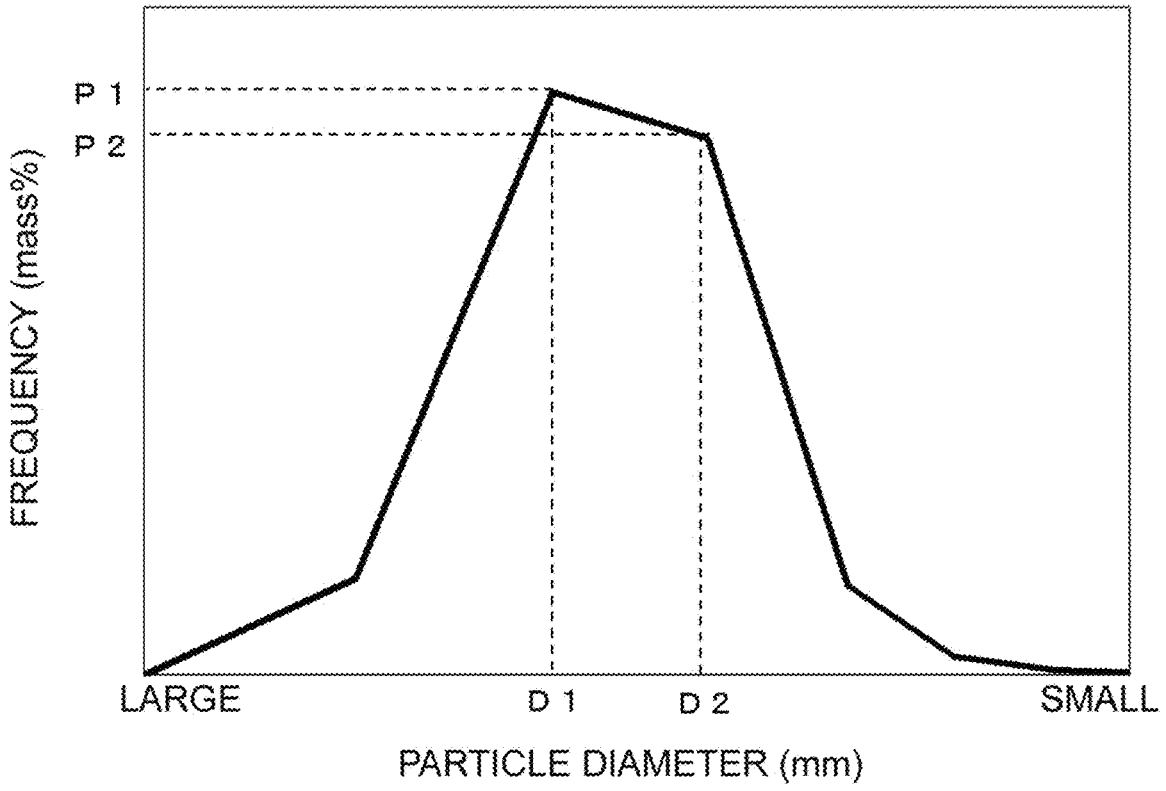
FIG. 1 is a schematic chart showing a particle diameter distribution of shot media according to an embodiment of the present disclosure.

FIG. 1 is a schematic chart showing a particle diameter distribution of the shot media according to the embodiment. The particle diameter distribution is a distribution of abundance ratios of each size (particle diameter) of particles. The vertical axis represents weight fractions (mass %) showing the frequency, and the horizontal axis represents particle diameters (mm). The particle diameter distribution may be expressed by connecting the frequencies with a straight line, for example. As shown in FIG. 1, the particle diameter distribution of the shot media before forming the operating mix according to the embodiment is bimodal and substantially continuous, having a first peak value P1 corresponding to a first peak, and a second peak value P2 corresponding to a second peak. That is, the shot media of the embodiment is configured including a first particle group A that corresponds to the first peak value P1 and a second particle group B that corresponds to the second peak value P2. The particle group is an aggregate of particles. Bimodality means a characteristic where, on a ridgeline of a mountain with the mode being the top, there are two points (peaks) projected toward the outer side of the mountain. The peak may not have to be the maximal value but may be an angular part projected toward the outer side. The top to be the mode configures one of the two peaks. That is, the distribution with two angular parts that are the top to be the mode and another peak is considered to have bimodality. Note that a distribution having two tops to be the mode is also considered to have bimodality.

A particle diameter D1 corresponding to the first peak value P1 and a particle diameter D2 corresponding to the second peak value P2 satisfy a relation of D1>D2. The first particle group A consisted of particles with a large particle diameter contributes to perform the blasting processing on the entire target area. However, the first particle group A has a low coverage (actual area of dents of shot media per unit area). The second particle group B consisted of particles with a smaller particle diameter than that of the particles included in the first particle group A has a higher coverage than the first particle group A. However, the second particle group B is inferior to the first particle group A in terms of the capability for performing blasting processing on the entire target area. The shot media of the embodiment including both the first particle group A and the second particle group B and exhibiting the particle diameter distribution having the first peak value P1 and the second peak value P2 are capable of improving the blasting processing performance and shortening the processing time due to a synergy effect of each of those.

In the embodiment, at least one of the first particle group A and the second particle group B may be an aggregate of particles having an angular part. Alternatively, in the embodiment, both the first particle group A and the second particle group B may be the aggregates of the particles having an angular part. Examples of the particles having an angular part may be acute-angled particles and columnar particles. With the angular parts, the blasting processing performance can be further improved.

In the embodiment, the first particle group A may be acute-angled particles. The particles having an acute angular part exhibit a high shaving force when collided with a processing target surface, so that the blasting processing can be performed with high efficiency.

An example of the acute-angled particles is grit. An example of a method for producing the grit will be described. After heat treatment is applied to off-standard products, remnants, and the like generated in a process of producing conventional shot media to give brittleness thereto, a crusher is used to crush them. Since those in a state of being brittle are crushed, acquired are anisotropic shapes having acute angular parts.

When hardness of the first particle group A is too hard, the processing target surface may become unnecessarily too rough or the life of the particles themselves may be shortened. Meanwhile, when the hardness of the first particle group A is too soft, the blasting processing cannot be fully performed. Considering the efficiency of the blasting processing and the life, Vickers hardness of the first particle group A may be adjusted to be HV390 to 900.

When the first particle group A is produced with cast steels, the aforementioned Vickers hardness can be adjusted with heat treatment.

Note here that when the particle diameter of the first particle group A is too large, the processing target surface may become unnecessarily too rough or may be shaved more than necessary. Meanwhile, when the particle diameter of the first particle group A is too small, the processing efficiency for the entire processing target surface becomes poor. Further, by also considering formation of the operating mix to be described later, the particle diameter D1 corresponding to the first peak value P1 in the embodiment may be defined as 0.710 mm to 1.000 mm (that is, 0.710 mm to 1.180 mm in actual particle diameter).

In the embodiment, the second particle group B may be columnar particles. In this case, dents can be equivalently formed on a region where dents are not formed with the first particle group A. Further, since side surfaces of the particles are curved surfaces, it is possible to perform blasting processing without making the processing target surface unnecessarily too rough.

An example of the columnar particles is cut wires. An example of a method for producing cut wires will be described. A columnar block called a billet is rolled into a wire of a predetermined diameter. For rolling, the billet is pulled to go through a plurality of dies so as to give a stress, so that a mechanical property (for example, toughness) can be improved. Thereafter, by serially cutting into a predetermined length, shot media configured with the columnar particles can be acquired.

When hardness of the second particle group B is too hard, the processing target surface may become unnecessarily too rough or the life of the particles themselves may be shortened. Further, ruptures may tend to occur when processing the billet into the wire, so that there may be a case where it is not possible to adjust to a desired particle diameter. When the hardness of the second particle group B is too soft, the blasting processing cannot be fully performed. Considering the efficiency of the blasting processing and the life, Vickers hardness of the second particle group B may be adjusted to be HV400 to 760.

When the second particle group B is produced with an iron-based material, the aforementioned Vickers hardness can be adjusted with heat treatment.

Note here that when the particle diameter of the second particle group B is too large, the processing target surface may become unnecessarily too rough or may be shaved more than necessary. Meanwhile, when the particle diameter of the second particle group B is too small, the processing efficiency for the entire processing target surface becomes poor. Further, by also considering formation of the operating mix to be described later, the particle diameter D2 corresponding to the second peak value P2 in the embodiment may be defined as 0.355 mm to 0.500 mm (that is, 0.355 mm to 0.600 mm in actual particle diameter).

Next, a method for performing blasting processing by using the shot media of the embodiment will be described.

Figure 2:
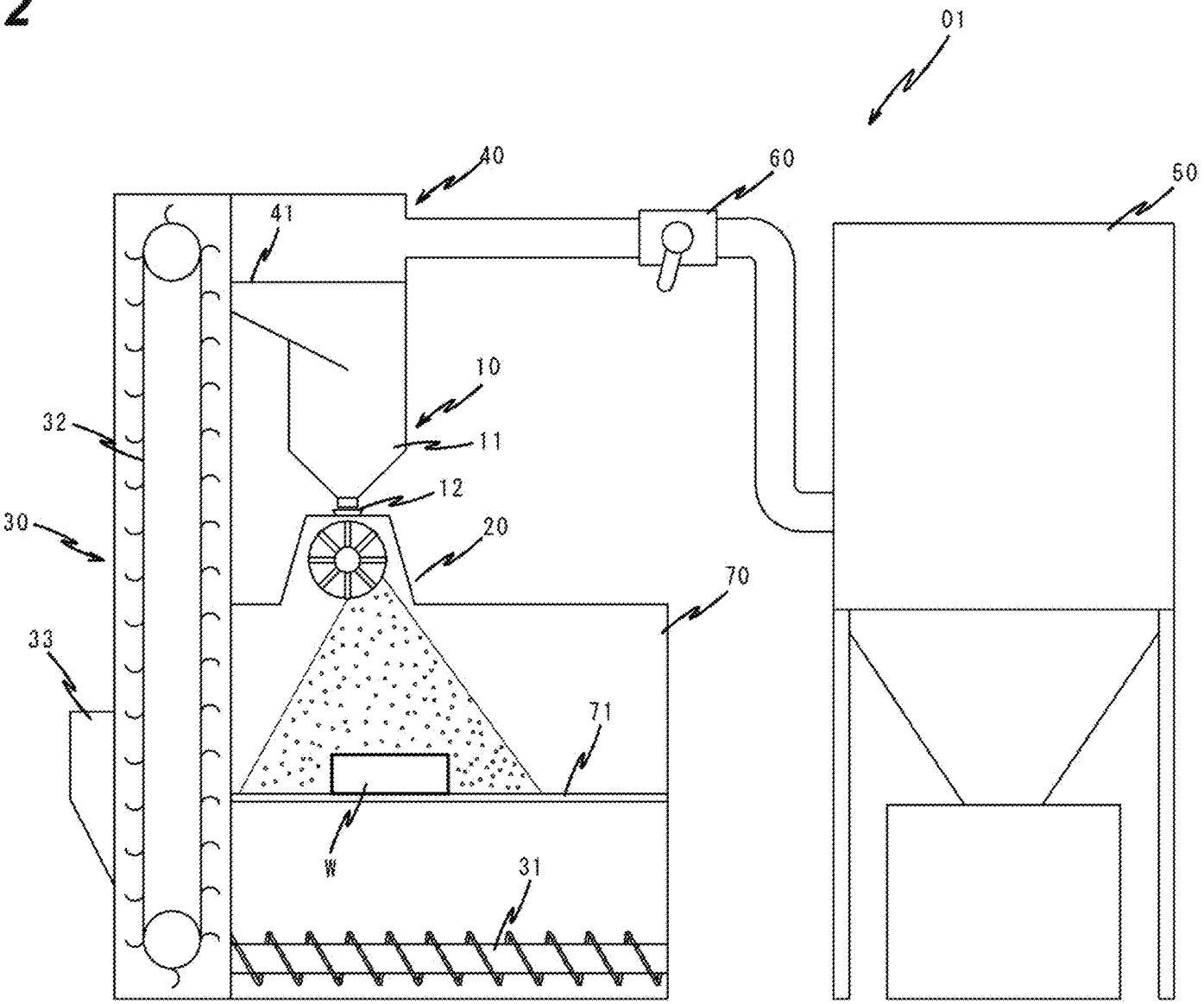
FIG. 2 is a schematic diagram showing a blasting apparatus used in the embodiment of the present disclosure.

First, a blasting apparatus used for the blasting processing of the embodiment will be described by referring to FIG. 2. A blasting apparatus 01 includes: a hopper 10 that stores the shot media and feeds a constant amount thereof; an impeller unit 20 that projects the shot media; a circulating apparatus 30 that circulates the shot media; a separator 40 that separates reusable shot media and other particles (referred to as "shot media and the like" as a whole hereinafter) from the particle group including the shot media; a dust collector 50; a damper 60 that adjusts a suction force of the dust collector 50; a projecting chamber 70; and a control apparatus (not shown) that controls actions of the blasting apparatus.

The hopper 10 includes a storage unit 11 where the shot media are stored, and a cut gate 12 provided under the storage unit 11. The cut gate 12 is a member for changing an area of an opening part provided on a passage from the storage unit 11 toward the impeller, and capable of feeding a specific amount of the shot media to the impeller unit 20.

The impeller unit 20 accelerates the shot media fed from the hopper 10 by a rotating blade to project them onto a processing target W placed on a placing table 71 provided within the projecting chamber 70. Thereby, the blasting processing is performed.

The circulating apparatus 30 includes a screw conveyor 31 and a bucket elevator 32. The blasting-processed shot media and the like are guided into the bucket elevator 32 by the screw conveyor 31. Then, the shot media and the like are conveyed to an upper side of the blasting apparatus 01 by the bucket elevator and fed to the separator 40. Further, the bucket elevator 32 is provided with a shot media supply port 33, so that the shot media can be supplied to the blasting apparatus 01.

A punching metal 41 is disposed between the bucket elevator 32 and the separator 40, so that coarse particles (for example, burrs) can be removed in advance from the shot media and the like. Processing for separating the reusable shot media and other particles is performed on the shot media and the like passed through the punching metal 41. In the embodiment, a wind-power type is employed. The shot media and the like are allowed to fall in an apron-like form. The separator 40 is connected to the dust collector 50, and an air flow generated by operation of the dust collector 50 is blown in a vertical direction to a falling direction to sort out the reusable shot media and other particles. The reusable shot media as heavier particles continue to fall further and are fed to the hopper 10. In the meantime, the other particles as lighter particles are drawn and recovered by the dust collector 50.

The damper 60 is provided on the passage from the separator 40 toward the dust collector 50, and controls an air amount and an air speed of the air flow blown to the shot media and the like. Since classification accuracy can be adjusted by the damper 60, it is possible to form and maintain the operating mix to be described later.

The control apparatus, not shown, controls each element configuring the aforementioned blasting apparatus 01. For the control apparatus, it is possible to use various kinds of arithmetic units such as a personal computer, motion controllers such as a programmable logic computer (PLC) and a digital signal processor (DSP), a high-performance mobile terminal, a high-performance mobile phone, and the like, for example.

Figure 3:
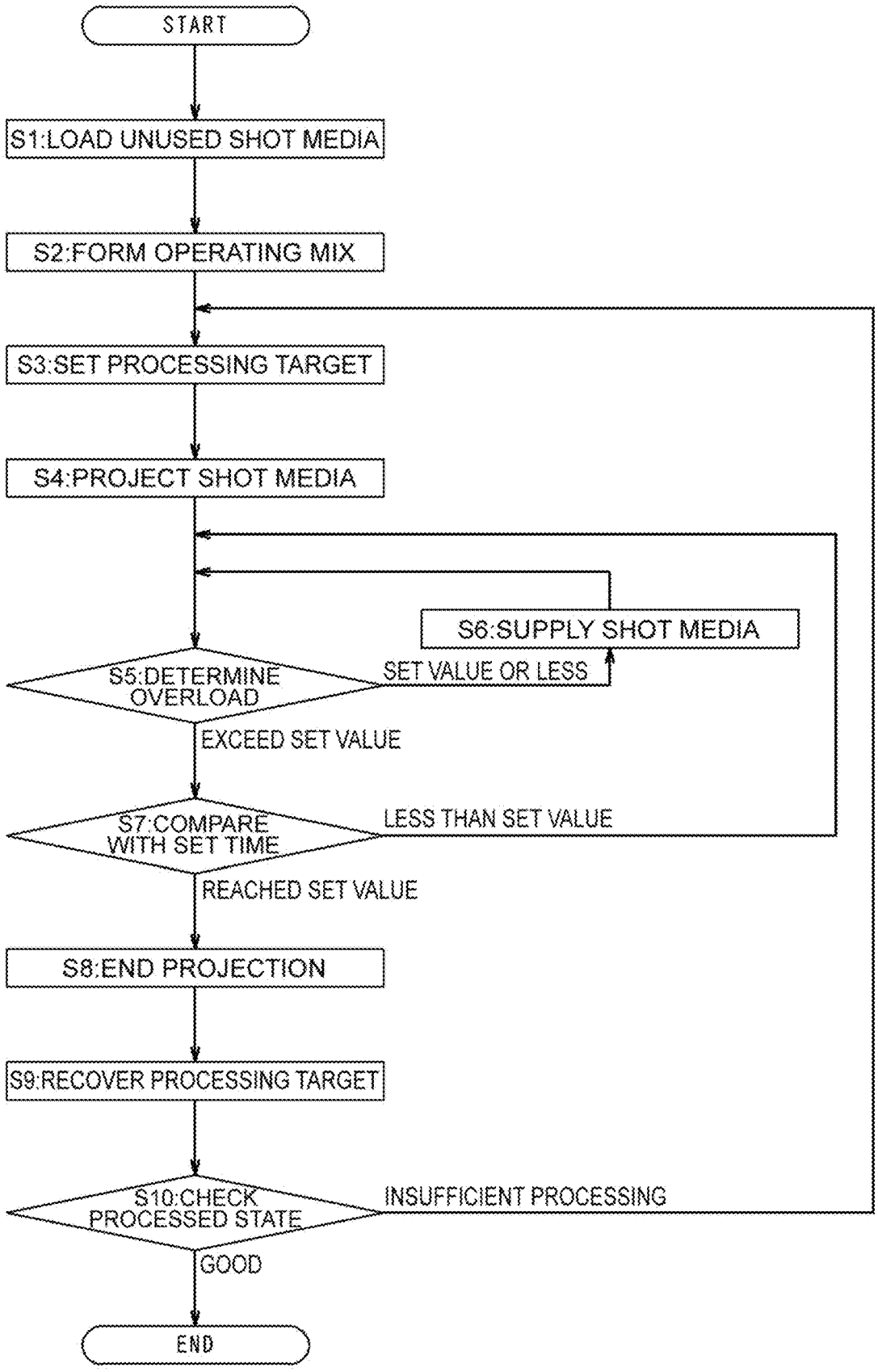
FIG. 3 is a flowchart showing blasting processing according to the embodiment of the present disclosure.

Next, steps of the blasting processing method by the blasting apparatus 01 will be described by referring further to FIG. 3.

<S1: Load Shot Media>

After starting the blasting apparatus 01, unused shot media are loaded to the blasting apparatus 01 from the shot media supply port 33.

<S2: Form Operating Mix>

By actions of the blasting apparatus 01, a series of operations for repeating projection of the shot media, discharge of fine powder outside the apparatus, and supply are performed. As a result, the particle diameter distribution of the shot media within the blasting apparatus 01 is stabilized to be a fixed particle diameter distribution different from the particle diameter distribution of unused shot media. That is, acquired is a state where an operating mix is formed. As to the shot media, it is important to manage the particle diameter distribution of the shot media in the apparatus after forming the operating mix such that efficient blasting processing can be performed.

Figure 4:
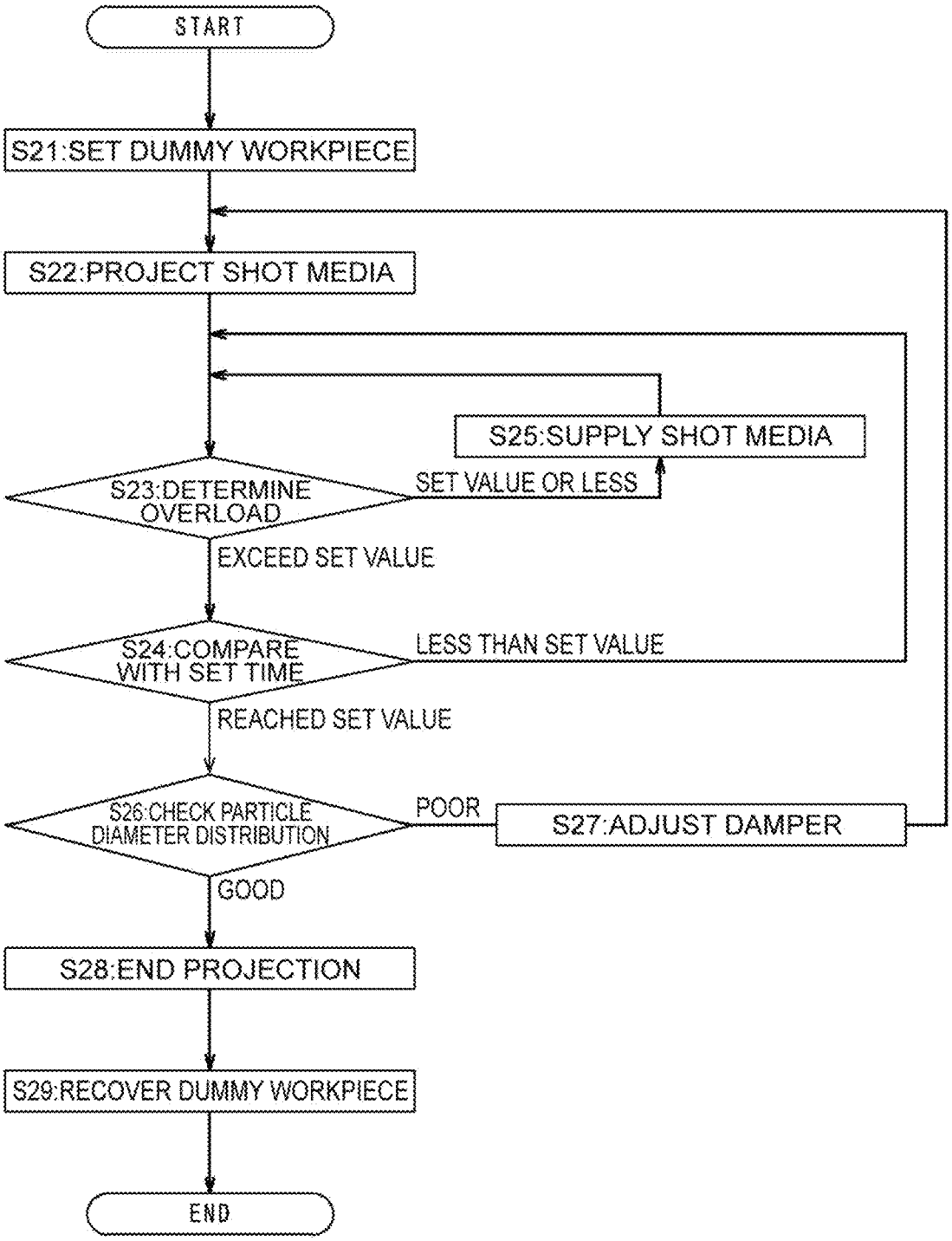
FIG. 4 is a flowchart showing steps for forming an operating mix according to the present disclosure.

FIG. 4 is an explanatory chart showing steps for forming an operating mix (step S2). For forming the operating mix, first, a dummy workpiece made of a material same as that of the processing target W, for example, is prepared in step S21, the blasting apparatus 01 is started in step S22, and a series of operations for repeating projection of the shot media, discharge of fine power outside the apparatus, and supply are performed on the dummy workpiece with a same condition as that of a case when blast-cleaning a cast product. As a result, the particle diameter distribution of the shot media in the blasting apparatus 01 comes to be a particle diameter distribution different from the particle diameter distribution of unused shot media. Note that it is also possible to do air-shot of the shot media without using the dummy workpiece.

Determination same as that of step S5 to be described later is made in step S23 and, when determined to supply the shot media, the processing is shifted to step S25 and returned to step S23 thereafter. When determined not to supply the shot media, the processing is shifted to step S24.

In following step S24, it is determined whether or not projection time has reached corresponding time set in advance for forming the operating mix. The processing is shifted to step S26 when the projection time has reached the corresponding time, and returned to step S23 when not reached.

In following step S26, the shot media are sampled to measure the particle diameter distribution to evaluate whether or not a desired operating mix is formed. Sampling of the shot media can be done from the cut gate 12, the bucket elevator 32, or the separator 40. When determined that the desired operating mix is formed (step S27: good), the processing is shifted to step S28 where projection is ended. Then, the dummy workpiece is recovered in step S29, and the steps for forming the operating mix are completed.

When determined that the desired operating mix is not formed (step S26: poor), the processing is shifted to step S27 where an opening level of the damper 60 is adjusted and then returned to step S22. In step S27, when there are a lot of small-diameter particles, it is possible to increase the opening level of the damper 60 to increase the amount of air for removing them, for example.

Note that after completing the steps for forming operating mix, it is also possible to provide a step of checking whether or not it is the particle diameter distribution having a desired blasting processing performance by performing blasting processing on a test piece.

Figure 5:
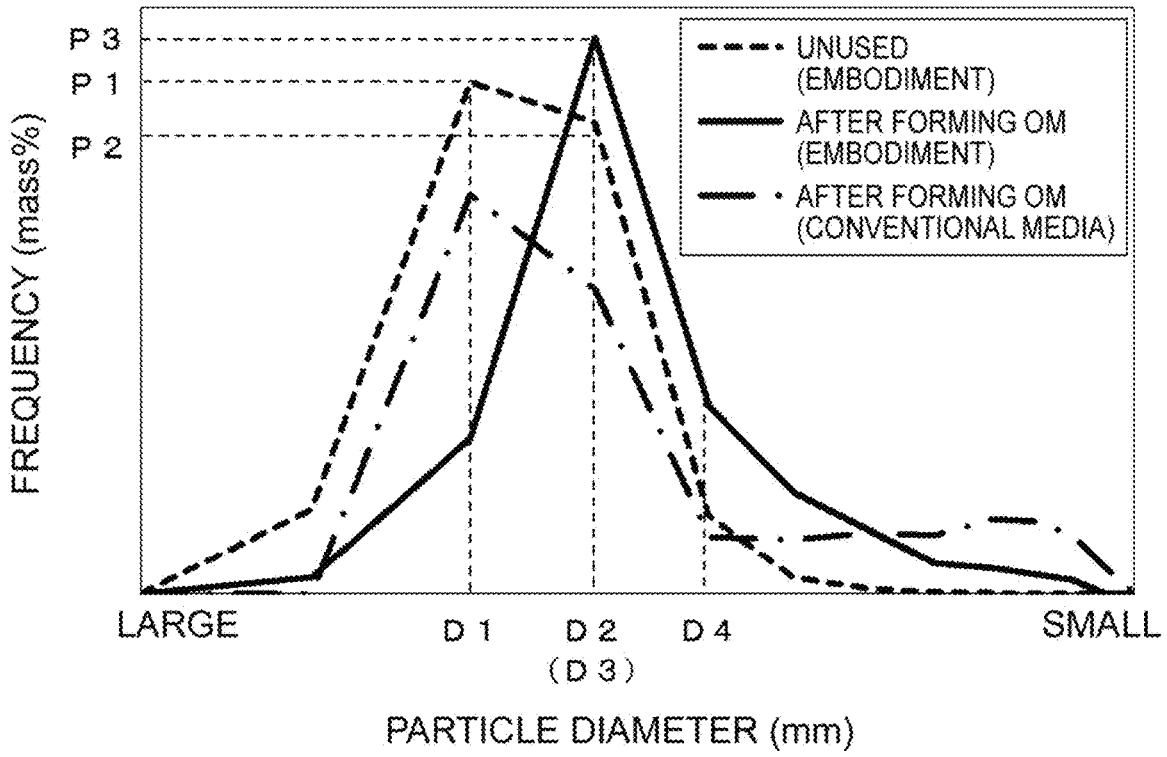
FIG. 5 is a schematic chart showing a particle diameter distribution of the shot media after forming an operating mix according to the embodiment of the present disclosure.

In the embodiment, as shown in FIG. 5, the particle diameter distribution in the blasting apparatus 01 after forming the operating mix is controlled to have a maximum value P3 of the frequency and controlled to be a distribution such that a particle diameter D3 corresponding to the maximum value P3 of the frequency is substantially the same with the particle diameter D2 corresponding to the second peak value P2 and that P3>P2 is satisfied. Further, the frequency of a particle diameter D4 that is smaller than the particle diameter D3 and neighboring to the particle diameter D3 is larger than that of the particle diameter distribution (an alternate long and short dash line in the chart) of conventional shot media in the blasting apparatus after forming the operating mix and forms an extremely sharp distribution (unimodal). By increasing the frequency of the particle diameter D2, efficiency of the blasting processing on the entire target area can be improved. Further, since the frequency of the particle diameter D3 is increased compared to that of the conventional shot media, it is possible to contribute to improving the coverage. Furthermore, by adjusting to be a sharp particle diameter distribution, small-diameter particles that are poor in the blasting processing efficiency are decreased, thereby making it possible to perform the blasting processing more efficiently.

In unused shot media, it becomes easy to adjust the particle size distribution after forming the aforementioned operating mix by setting the particle diameter D1 corresponding to the first peak value P1 to be 0.710 mm to 1.000 mm (that is, 0.710 mm to 1.180 mm in actual particle diameter) and the particle diameter D2 corresponding to the second peak value P2 to be 0.355 mm to 0.500 mm (that is, 0.355 mm to 0.600 mm in actual particle diameter).

<S3: Set Processing Target>

The processing target W as a subject of blast-cleaning is placed on the placing table 71 within the projecting chamber 70.

<S4: Project Shot Media>

In a state where the operating mix is formed, the shot media are projected toward the processing target W to perform blasting processing on the surface of the processing target W.

<S5: Determine Overload>

It is determined whether or not to supply the shot media based on a load current value of an ammeter of the impeller unit 20 while projecting the shot media. When the load current value is larger than a current value set in advance and a predetermined fluctuation value or less, it is determined not to supply the shot media and the processing is shifted to step S6. When the load current value is the current value set in advance or less or exceeds the predetermined fluctuation value, it is determined to supply the shot media and the processing is shifted to step S7.

<S6: Supply Shot Media>

New shot media in a predetermined amount are supplied from a shot supply port 13*a*, and the processing is returned to step S5. The shot media are supplied in a predetermined amount that is set by considering the load and the like of the bucket elevator. Thereby, a desired operating mix can be maintained.

<S7: Determine Processing Time>

It is determined whether or not projecting time has reached set time that is set in advance for performing blast-cleaning of the processing target W. The processing is shifted to step S8 when the projecting time has reached the set time, and returned to step S5 when not reached.

<S8: End Projection>

The action of the circulating apparatus 30 is stopped to end the projection.

<S9: Recover Processing Target>

The door of the projecting chamber 70 is opened, and the processing target W is taken out.

<S10: Check Processed State>

The processed state of the processing target W is evaluated by visual inspections or the like to determine whether or not the blasting processing is completed. When determined that the blasting processing is completed (step S10: good), a series of operations are ended. When determined that the blasting processing is not completed (step S10: lack of processing), the processing is returned to step S3.

The aforementioned blasting processing method is capable of making the particle diameter distribution of the shot media after forming the operating mix be a distribution suited for blasting processing, so that the blasting processing method can improve both the blasting processing performance and the coverage for the entire processing area.

Next, results of a test performed for checking the effect of the shot of the embodiment will be described.

As the shot media (example) of the embodiment, shot media with D1=0.710 mm and D2=0.600 mm were prepared. Further, acute-angled shot media (comparative example) having an extreme value in the particle diameter 0.425 mm were prepared for comparison.

Life spans of those shot media were evaluated. After 100 g of the shot media were thrown into a life test apparatus ("The Test Ervin Machine" produced by Ervin Industries Inc.) and projected toward steels (HRC65) at a projection speed of 60 m/s, the shot media were classified with sieves to remove small-diameter particles. Then, unused shot media were added to keep the whole amount as 100 g, and the life test apparatus was operated in a same manner. This operation was repeated, and the number of projections (cycles) at the point where the whole shot media thrown initially were replaced was defined as a life value.

In the comparative example, it was 1194 cycles. Meanwhile, in the example using the shot media of the embodiment, it was 4583 cycles. This shows that the shot media of the embodiment has the life of approximately 380% compared to that of the conventional shot media.

Next, results of the blasting processing performed by using those shot media will be described. The blasting processing was performed with a projection density of 50 $kg/m^2$ on coated rolled steels for general structure (SS400 defined in JIS G3010: 2004).

After the blasting processing, evaluations of peeling-off degrees of the coating were performed. For the evaluations, the blasting-processed chromium steels were used. The area with dents with respect to a designated area was calculated by observation with a microscope. The peeling-off degree of the example was 75% while the peeling-off degree of the comparative example was 60%, which shows that the shot media of the embodiment is capable of efficiently performing the blasting processing on the entire processing target.

The shot media according to the embodiment of the present disclosure can be preferably used for various kinds of blasting processing such as shake-out of a cast product after casting, deburring of a metal product, removal of scale such as rust, undercoat processing before coating, peeling off coating, removal of a surface thin layer of a floor surface or a wall surface (for example, a concrete road surface, a concrete subgrade for track rail, a factory concrete floor surface, or a concrete wall surface of a structure), and the like.

REFERENCE SIGNS LIST

01 . . . Blasting apparatus, 10 . . . Hopper, 20 . . . Impeller unit, 30 . . . Circulating apparatus, 40 . . . Separator, 50 . . . Dust collector, 60 . . . Damper, 70 . . . Projecting chamber, W . . . Processing target

The invention claimed is:

1. A blasting processing method using shot media, the shot media is Iron-based shot media, wherein:

a particle diameter distribution of the shot media before forming an operating mix is bimodal and continuous; and both a first particle group corresponding to a first peak and a second particle group corresponding to a second peak are aggregates of particles in a shape having an angular part, the method comprising:

a step of loading the shot media being unused on a blasting apparatus;

a step of forming the operating mix for stabilizing the particle diameter distribution of the shot media to be a fixed particle diameter distribution by operating the blasting apparatus; and a step of projecting the shot media with the operating mix being formed toward a processing target, wherein the particle diameter distribution after forming the operating mix is unimodal, and a particle diameter segment corresponding to a maximum value of a frequency is the same as a particle diameter segment of the second particle group.

2. The blasting processing method according to claim 1, wherein the particles included in the first particle group are particles having an acute angular part and have Vickers hardness of HV390 to 900.

3. The blasting processing method according to claim 2, wherein the particles included in the second particle group are columnar particles having an angular part and have Vickers hardness of HV400 to 760.

4. The blasting processing method according to claim 3, wherein a particle diameter segment of the first particle group is 0.710 mm to 1.180 mm, and a particle diameter segment of the second particle group is 0.355 mm to 0.600 mm.

5. The blasting processing method according to claim 2, wherein a particle diameter segment of the first particle group is 0.710 mm to 1.180 mm, and a particle diameter segment of the second particle group is 0.355 mm to 0.600 mm.

6. The blasting processing method according to claim 1, wherein the particles included in the second particle group are columnar particles having an angular part and have Vickers hardness of HV400 to 760.

7. The blasting processing method according to claim 6, wherein a particle diameter segment of the first particle group is 0.710 mm to 1.180 mm, and a particle diameter segment of the second particle group is 0.355 mm to 0.600 mm.

8. The blasting processing method according to claim 1, wherein a particle diameter segment of the first particle group is 0.710 mm to 1.180 mm, and a particle diameter segment of the second particle group is 0.355 mm to 0.600 mm.

* * * * *